US005803693A

United States Patent [19]

Choiniere et al.

[11] Patent Number: 5,803,693

[45] Date of Patent: Sep. 8, 1998

[54] SWIVELING ROOFING WASHER

[75] Inventors: Stanley W. Choiniere, Southwick; Martin G. Riccitelli, Westfield; Tad A. Weiss, Westhampton, all of Mass.

[73] Assignee: Olympic Manufacturing Group, Inc., Agawam, Mass.

[21] Appl. No.: 842,808

[22] Filed: Apr. 17, 1997

[51] Int. Cl.[6] ..... F16B 43/00; F16B 43/02

[52] U.S. Cl. ..... 411/537; 411/545; 52/410; 405/302.1

[58] Field of Search ..... 411/531, 533, 411/537, 545; 52/410, 512; 405/302.1

[56] References Cited

U.S. PATENT DOCUMENTS

| | | | |
|---|---|---|---|
| 3,164,323 | 1/1965 | Steele et al. | 411/537 X |
| 3,422,721 | 1/1969 | Yonkers | 411/537 X |
| 4,445,808 | 5/1984 | Arya | 411/531 X |
| 5,267,423 | 12/1993 | Giannuzzi | 52/410 |

FOREIGN PATENT DOCUMENTS

| | | | |
|---|---|---|---|
| 1192635 | 5/1960 | France | 405/302.1 |
| 968630 | 9/1964 | United Kingdom | 405/302.1 |

*Primary Examiner*—Neill R. Wilson
*Attorney, Agent, or Firm*—Alix, Yale & Ristas, LLP

[57] ABSTRACT

A swiveling roofing washer for use with a roofing fastener has a plate. The plate defines a centrally positioned fastener opening. The plate further has a bottom surface for engagement to a roofing membrane, and an oppositely positioned top surface. The top surface has a swivel surface portion defining a convex surface adjacent and coaxial with the fastener opening. The swivel surface further defines a fastener head receiving channel adjacent the convex portion and coaxial with the fastener opening for engagement with the head portion of a roofing fastener.

21 Claims, 4 Drawing Sheets

SWIVELING ROOFING WASHER

BACKGROUND OF THE INVENTION

This invention relates generally to plates which are employed for fastening roofing systems. More particularly, this invention relates to a swiveling roofing washer which is employed in conjunction with a roofing fastener for securing a roofing membrane and insulation material to a roof deck.

It is conventional for roofing systems to employ a layer of insulation material installed over a rigid roof deck. A weather resistant roofing membrane which provides weatherproof sealing for the roofing system is installed over the insulation material. Elongated roofing fasteners having large plate-like roofing washers form fastener assemblies for supporting the insulation material and roofing membrane onto the roof deck. The fastener assemblies extend through openings bored in the roofing membrane and insulation materials and engage the underlying roof deck. Further layers of the weather resistant roofing membrane may be installed over the roofing washers and heads of the roofing fasteners to provide additional sealing for the roofing system.

The weather resistant roofing membrane can be subject to external upward lifting loads during certain high wind conditions. These wind generated lifting loads apply forces to the roofing membrane which tend to pull or balloon the roofing membrane away from the underlying insulation material. The roofing membrane thereby applies an uneven vertically upward force which is exerted against the conventional roofing washers and roofing fasteners employed to hold the roofing membrane and insulation material in position on the roofing deck. The roofing fastener will typically remain securely affixed to the underlying roof deck under most conditions. However, the insulation material applied over the roof deck is typically spongy or provides a low resistance to a crushing or compressive force relative to the underlying roof deck. Therefore, as the roofing membrane lifts or balloons away from the insulation material, the roofing membrane will apply a force to the conventional roofing washer to rotate the conventional roofing washer out of the plane of the top surface of the insulation material. The conventional roofing washer will therefore pivot around the fixed roofing fastener. One edge of the conventional roofing washer will be lifted away from the underlying insulation material, and the opposite edge will tend to be driven downward into the softer insulation material as the conventional roofing washer is rotated by the underlying roofing membrane on the fixed roofing fastener.

The rotation of the conventional roofing washer typically results in the fastener opening in the roofing washer being distorted and enlarged. The enlargement of the fastener opening allows the roofing washer to be pulled over the expanded head of the roofing fastener, thereby allowing the roofing membrane to further lift and pull away from the insulation material. The removal of the conventional roofing washer from the roofing fastener destroys the hold down function of the roofing fastener assembly.

SUMMARY OF THE INVENTION

Briefly stated, the invention in a preferred form is a swiveling roofing washer forming a generally circular or polygonal plate. The plate defines a centrally positioned fastener opening therethrough. The swiveling roofing washer is employed with a conventional roofing fastener having an elongated shank portion and an expanded head portion. The underside of the expanded head portion of the roofing fastener defines a radially extending engagement surface for engaging the roofing washer and holding the swiveling roofing washer onto the weather resistant roofing membrane of a roofing system. The elongated shank portion of the roofing fastener is adapted for passage through a layer of insulation material and securement to a roof deck.

The swiveling roofing washer in accordance with the invention has a lower surface and an oppositely positioned upper surface. The lower surface engages the roofing membrane when the swiveling roofing washer is installed onto the roofing system. The upper surface of the swiveling roofing washer defines a swivel surface portion adjacent the fastener opening. The swivel surface portion has an annular convex surface immediately adjacent and coaxial with the fastener opening. The swivel surface portion further defines an annular fillet or channel. The channel is preferably coaxial with the fastener opening and positioned generally radially outward from the convex surface.

In use, the swiveling roofing washer in accordance with the invention is installed in a conventional manner. A hole is pre-drilled through the weather resistant roofing membrane, insulation, and into the roofing deck. A roofing fastener is passed through the fastener opening, the pre-drilled opening in the roofing membrane and insulation material and into the roof deck. The fastener engages the underlying roofing deck to support the swiveling roofing washer in a secure position on the roofing membrane. The swiveling roofing washer can also be employed with self-drilling roofing fasteners where no pre-drilled hole is required for installation.

A rotating force can be placed on the swiveling roofing washer during periods of high wind load as the roofing membrane lifts from the insulation material. The rotating force rotates the swiveling roofing washer out of the plane of the insulation material. The convex surface of the swivel surface portion of the roofing washer swivels on the engagement surface on the underside of the expanded head portion of the roofing fastener as the roofing membrane rotates the swiveling roofing washer. At higher angles of rotation, the lower edge of the expanded head portion of the roofing fastener engages the channel of the swivel surface portion. The engagement of the lower edge of the expanded head portion with the channel of the swivel surface portion, in combination with the engagement of the convex surface with the underside of the head portion, provides additional resistance to the swiveling roofing washer being pulled over the head portion of the fastener. The weather resistant roofing membrane is thereby maintained on the roofing system by the engagement of the lower edge of the head portion in the channel in the roofing washer to prevent pull through of the head portion through the fastener opening.

In a further embodiment in accordance with the invention, the swiveling roofing washer further includes multiple annular reinforcement ribs generally coaxial with the fastener opening. Each reinforcement rib defines an engagement ridge on the lower surface of the swiveling roofing washer for surface to surface contact with the weather resistant roofing membrane.

In one preferred form, an outer engagement ridge defined by the reinforcing rib at the outer periphery of the swiveling roofing washer defines a first plane. An inner engagement ridge of the reinforcing rib positioned closer to the fastener opening defines a second plane. The second plane is positioned above the first plane of the outer engagement ridge. Therefore, when the swiveling roofing washer is installed, the outer engagement ridge of the outer reinforcing rib will first contact the weather resistant roofing membrane. The swiveling roofing washer is preferably stamped from sheet metal having a spring-like resiliency. The inner engagement ridge and roofing membrane will define a spring gap therebetween. As the roofing fastener is fully installed into the roofing decking, the swiveling roofing washer will resiliently deform, bringing the inner engagement ridge of the inner reinforcing rib into contact with the roofing membrane. The swiveling roofing washer will resiliently return to its original shape if the insulation collapses or settles over time, and therefore redefine the spring gap between the inner engagement ridge and the roofing membrane. The swiveling roofing washer will as a result of the positioning of the inner and outer engagement ridges, remain in contact to the roofing membrane and the head portion of the roofing fastener to provide a hold down function throughout the operational life of the roofing system.

An object of the invention is to provide a new and improved swiveling roofing washer for fastening a weather resistant roofing membrane and layer of insulation material to a roof deck.

A further object of the invention is to provide a new and improved swiveling roofing washer having an increased resistance to being pulled over the expanded head portion of a roofing fastener.

A still further object of the invention is to provide a fastener assembly highly resistant to high loads exerted by a roofing membrane.

Other objects and advantages of the invention will become apparent from a review of the drawings and the specification.

BRIEF DESCRIPTION OF THE INVENTION

DETAILED DESCRIPTION OF THE PREFERRED EMBODIMENT

With reference to the drawings, wherein like numerals represent like components throughout the figures, a swiveling roofing washer in accordance with the invention is generally designated by the numeral 10.

Figure 1:
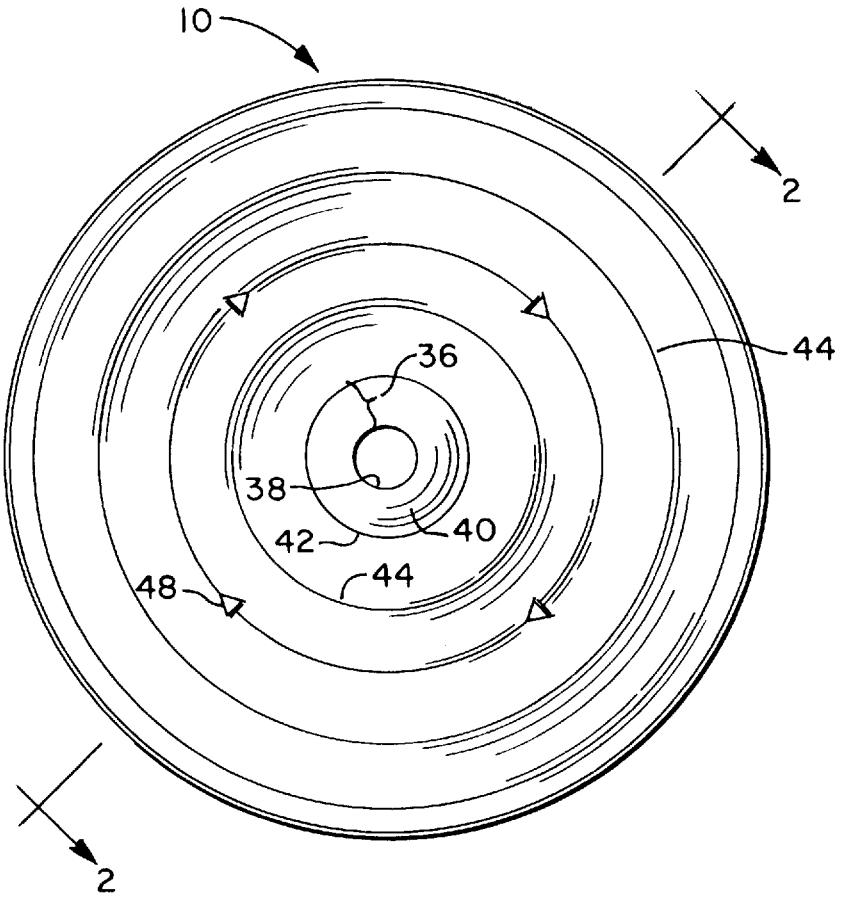
FIG. 1 is a top plan view of a swiveling roofing washer in accordance with the invention.
Figure 2:
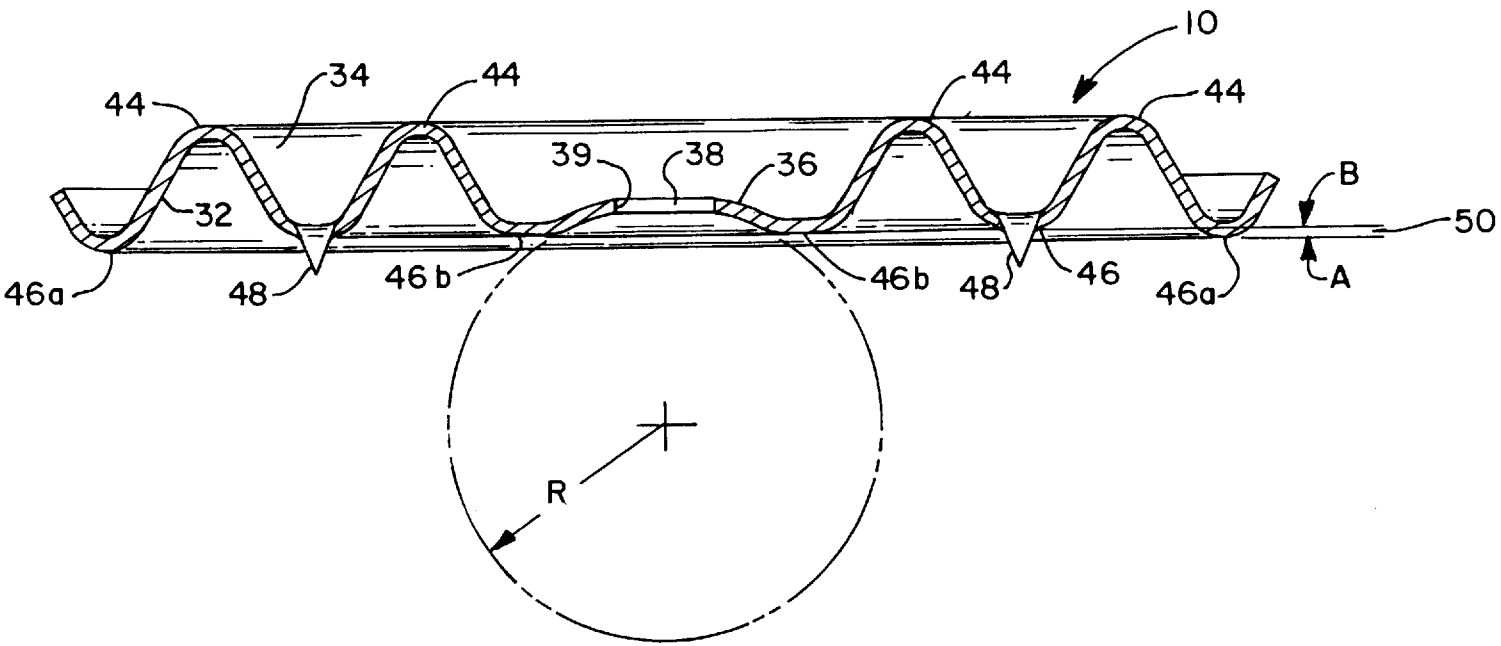
FIG. 2 is a cross-sectional view of the swiveling roofing washer of FIG. 1 taken along the line 2—2 and further illustrated in schematic relationship to further describe the shape thereof.
Figure 3:
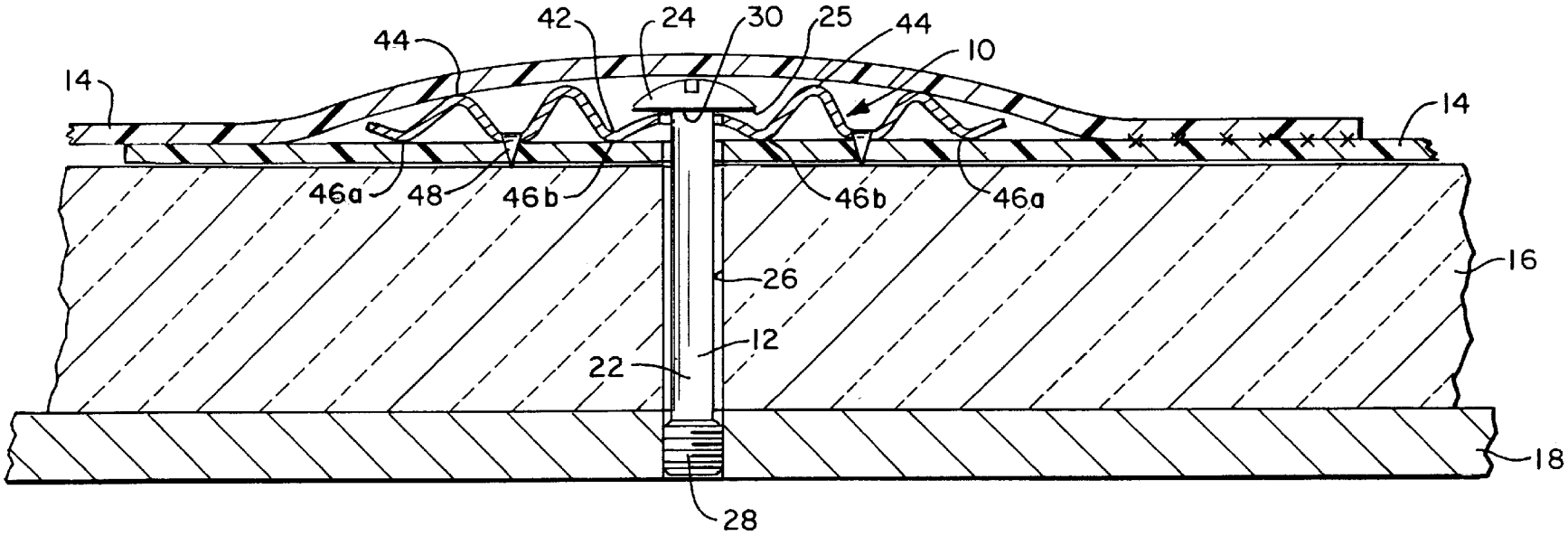
FIG. 3 is a partial cross-sectional view of the swiveling roofing washer of FIG. 1 in combination with a roofing fastener installed onto a roofing system.

With reference to FIGS. 1–3, the swiveling roofing washer 10 in accordance with the invention is supported by a conventional roof fastener 12 onto a roofing system of a weatherproof membrane 14 over a layer of insulation material 16 supported by a roofing deck 18. The insulation layer 16 and roof deck 18 are compositions and constructions well known in the art of roofing systems. The swiveling roofing washer 10 defines a lower surface 32 for contact with the roofing membrane 14 and an upper surface 34. The upper surface 34 defines a swiveling surface portion 36 adjacent an inside edge 39 of a centrally positioned fastener opening 38. The swiveling surface portion 36 is preferably annularly positioned adjacent the fastener opening 38. The swiveling surface portion 36 has a convex surface 40 immediately adjacent the fastener opening 38 and radially extending therefrom. The convex surface 40 can be conical or a surface of curvature such as a spherical or other contoured surface. The swiveling roofing washer 10 is preferably axially symmetric with the fastener opening 38 but can alternately be polygonal or other shapes.

The roofing fastener 12 is preferably of a conventional construction having an elongated shank portion 22 and an expanded head portion 24. The shank portion 22 defines a threaded portion 28 for threaded engagement to the roof deck 18. The underside of the head portion 24 defines a radially extending engagement surface 30 terminating in an adjacent lower edge 25 of the head portion 24. The convex portion 40 of the swivel surface 36 contacts the engagement surface 30 of the underside of the head portion 24 of the roofing fastener 12 when the roofing fastener 12 and swiveling roofing washer 10 are installed on a roofing system. The shank portion 22 of the roofing fastener 12 is generally orthogonal to the swiveling roofing washer 1 0 when installed in the roof system. In one preferred form of the swiveling roofing washer 10, the convex portion 40 is generally spherical, having a radius of curvature R of about 0.4±0.125 inches. The swivel surface 36 further defines an annular fillet or channel 42 radially outward from the convex portion 40 and generally coaxial with the fastener opening 38. The channel 42 is dimensioned to receive the lower edge 25 of the head portion 24 of the roofing fastener 12.

An array of fastener assemblies each comprising the swivel roofing washer 10 and roofing fastener 12 holds down a roofing system of the weather resistant roofing membrane 14 over a layer of the insulation material 16 disposed on the roofing deck 18. The swiveling roofing washer 10 is positioned over a through-bore 26 through the roofing membrane 14 and insulation material 16. The roofing fastener for typically non-concrete applications is self-drilling. Therefore, no predrilled through-bore is required for these roofing applications. The roofing fastener forms the through-bore 26. The roofing fastener 12 is installed through the fastener opening 38 and threadably engages the roofing deck 18 with the threaded portion 28 of the shank portion 22. It should be recognized that the swiveling roofing washer 10 is also compatible with other roofing fasteners that directly engage the insulation material, or are driven or forced into the roof deck 18 for securement. The roofing fastener 12 is driven or rotated into the roof deck 18 until the head portion 24 of the roofing fastener 12 engages the swiveling roofing washer 10 to hold down the swiveling roofing washer 10 on the roofing membrane 14. The engagement surface 30 of the head portion 24 of the fastener 12 engages in surface to surface contact the convex portion 40 of the swivel surface 36 of the swiveling roofing washer 10 when the fastener 12 is fully installed in the roofing deck 18. (See FIG. 3) An additional layer of weather resistant roofing membrane 14 can be installed over the head portion 24 of the roofing fastener 12 and swiveling roofing washer 10 in order to provide additional weatherproofing for the roof system.

Figure 4:
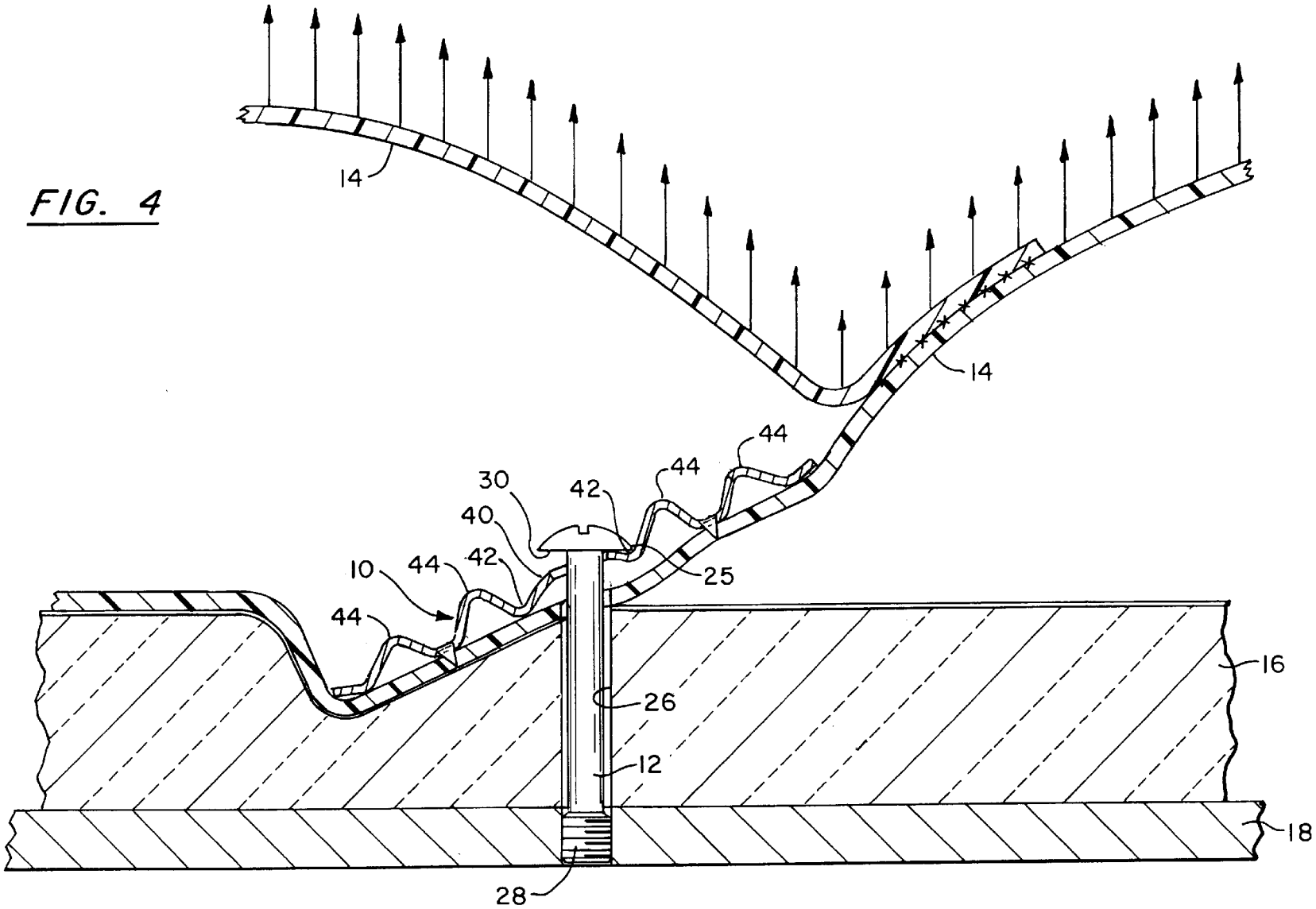
FIG. 4 is a partial cross-sectional view of the swiveling roofing washer, roofing fastener and roofing system of FIG. 3 shown under high wind load conditions.

Under certain wind induced conditions, the roofing membrane 14 may lift from the insulating material 16, thereby tilting or rotating the swiveling roofing washer 10 out of the plane of the upper surface of the insulating material 16. (See FIG. 4) Under these conditions, the convex portion 40 of the swiveling surface 36 slides against the engagement surface 30 on the underside of the head portion 24 of the roofing fastener 12. The swiveling roofing washer 10 returns to the original position in the plane of the insulation material 16 when the wind force subsides. Under more extreme wind conditions, the lower edge 25 of the head portion 24 of the roofing fastener 12 is forced into the channel 42 positioned radially outward from the swivel surface 36. The engagement of the lower edge 25 of the head portion 24 with the channel 42 maintains the swiveling roofing washer 10 onto the roofing fastener 12 and therefore maintains the weather resistant roofing system in position. The swiveling roofing washer 10 can again swivel or rotate back to a position generally in the plane of the top surface of the insulating material 16 when the wind conditions have subsided.

The fastener opening 38 is further preferably dimensioned to closely fit the shank portion 22 of the roofing fastener 24. Therefore, the inside edge 39 of the swiveling roofing washer 10 will grip or hold the shank portion 22 of the roofing fastener 12 as the swiveling roofing washer 10 is rotated out of the plane of the insulating material 16 by the roofing membrane 14.

The swiveling roofing washer 12 is preferably further provided with multiple reinforcing ribs 44. The reinforcing ribs 44 provide additional mechanical rigidity to resist bending of the swiveling roofing washer 10. In one form of the roofing washer 10 in accordance with the invention, the reinforcing ribs 44 form multiple annular engagement ridges 46 on the lower washer surface 32 of the swiveling roofing washer 10. The engagement ridges 46 are preferably rounded off or radiused to reduce cutting of the engagement ridges 46 into the roofing membrane 14 during installation of the roofing fastener 12. The swiveling roofing washer 10 can be further provided with prongs 48 on the engagement ridges 46 to extend into the roofing membrane 14 and prevent rotation of the swivel roofing washer 10 during installation of the fastener 12.

The swiveling roofing washer 10 is preferably formed from a flexible sheet metal material coated for corrosion resistance. The swiveling roofing washer 10 is typically punched or stamped from the sheet metal material to form the reinforcing ribs 44, ridges 46, fastener opening 38, swivel surface 36 and channel 42.

In a still further embodiment in accordance with the invention, the swiveling roofing washer 10 has an outer engagement ridge 46*a* and an inner engagement ridge 46*b*. The outer engagement ridge 46*a*, positioned radially outward at the outer periphery of the swiveling roofing washer 10, defines a first plane A. The inner engagement ridge 46*b*, positioned radially inward closest to the fastener opening 38, defines a second plane B parallel to and spaced apart from the first plane A. The second plane B is positioned closer to the swivel surface 36. The first plane A and second plane B define a spring gap 50 therebetween.

The roofing washer 10 will resiliently deform to place the inner engagement ridge 46*b* in the same plane A of the outer engagement ridge 46*a* thereby eliminating the spring gap 50 during installation of the roofing fastener 12 into the roof deck 18. The spring-like resiliency of the swiveling roofing washer 10 will reform the spring gap 50 if the insulation material 16 undergoes shrinkage or deformation. The return of the swiveling roofing washer 10 toward its original shape to redefine the spring gap 50 maintains the swivel surface 36 in engagement with the engagement surface 30 of the expanded head portion 24 of the roofing fastener 12 under changing roofing system conditions.

The swiveling roofing washer 10 is preferably formed as a circular or polygonal plate with a centrally positioned fastener opening 38, but the invention can be implemented with roofing washers having alternative shapes and off-center fastener openings.

While preferred embodiments of the present invention have been illustrated and described in detail, it should be readily appreciated that many modifications and changes thereto are within the ability of those of ordinary skill in the art. Therefore, the appended claims are intended to cover any and all of such modifications which fall within the true spirit and scope of the invention.

What is claimed is:

1. A swiveling roofing washer for use with a roofing fastener having a shank portion and an expanded head portion comprising:

a plate defining a centrally positioned fastener opening and comprising a bottom surface for engagement to a roofing membrane, an opposite top surface including an upper portion and a swivel surface portion adjacent said fastener opening and disposed between said bottom surface and said upper portion, said swivel surface portion defining a convex surface adjacent and coaxial with said fastener opening and a fastener head receiving channel disposed between said bottom surface and said upper portion and adjacent said convex portion, said channel being coaxial with said fastener opening for engagement with the head portion of a roofing fastener.

2. The swiveling roofing washer of claim 1 wherein said convex surface is spherical.

3. The swiveling roofing washer of claim 2 wherein said convex surface has a radius of curvature of about 0.4 inches.

4. The swiveling roofing washer of claim 1 wherein said plate further comprises a reinforcing rib.

5. The swiveling roofing washer of claim 4 wherein said reinforcing rib is annular and coaxial with said fastener opening.

6. The swiveling roofing washer of claim 1 wherein said plate comprises a plurality of annular reinforcing ribs coaxial with said fastener opening.

7. The swiveling roofing washer of claim 6 wherein said plate is axially symmetric about the fastener opening.

8. The swiveling roofing washer of claim 1 wherein said lower surface further defines an annular outer engagement ridge coaxial with said fastener opening and defining a first plane, and an annular inner engagement ridge coaxial with said fastener opening and defining a second plane, said first and second planes being mutually parallel and spaced apart and said second plane being positioned closer to said convex surface than said first plane.

9. The swiveling roofing washer of claim 1 further comprising roof engagement means extending from said bottom surface.

10. A roofing fastener assembly for fastening a roofing membrane and insulation material on a roofing deck comprising:

a roofing fastener having a shank portion and an expanded head portion, wherein said expanded head portion defines a radial engagement surface and a fastener edge portion adjacent said engagement surface;

a swiveling roofing washer comprising a plate defining a central fastener opening and comprising a bottom surface for engagement to a roofing membrane, a top surface including an upper portion and having a swivel engagement portion adjacent said fastener opening and disposed between said bottom surface and said upper portion, said swivel engagement portion having a convex surface coaxial and adjacent with said fastener opening and a channel coaxial with said fastener opening and adjacent said convex surface, said channel being disposed between said upper portion and said bottom surface, whereby said engagement surface is in surface to surface contact with the said convex surface when said roofing fastener extends through said fastener opening and is orthogonal to said swiveling roofing washer and said fastener edge portion being engageable in said channel when said washer is tilted relative to said fastener.

11. The roofing fastener assembly of claim 10 wherein said convex surface is spherical.

12. The roofing fastener assembly of claim 11 wherein said convex surface has a radius of curvature of about 0.4 inches.

13. The roofing fastener assembly of claim 11 wherein said plate further comprises an annular reinforcing rib coaxial with said fastener opening.

14. The roofing fastener assembly of claim 10 wherein said lower surface of said swiveling roofing washer further defines an annular outer engagement ridge coaxial with said fastener opening and defining a first plane, and an annular inner engagement ridge coaxial with said fastener opening and defining a second plane, said first and second planes being parallel and spaced apart, said second plane being positioned closer to said convex surface than said first plane.

15. The roofing fastener assembly of claim 14 wherein said swiveling roofing washer further comprises a plurality of annular reinforcing ribs coaxial with said fastener opening.

16. The roofing fastener assembly of claim 15 wherein said swiveling roofing washer is axially symmetric about said fastener opening.

17. The roofing fastener assembly of claim 14 wherein said convex surface is spherical.

18. A roofing system assembly comprising:

a deck surface;

a layer of insulation material on said deck surface;

a membrane on said insulation material, said membrane and insulation material defining a fastener throughbore;

a swiveling roofing washer having a plate defining a fastener opening positioned generally coaxial with said throughbore, said plate having a bottom surface engaging said membrane and a top surface defining a swivel surface portion adjacent said fastener opening, said swivel surface portion having a convex surface adjacent and coaxial with said fastener opening and a channel adjacent said convex surface and coaxial with said fastener opening; and a roofing fastener having a shank portion and an expanded head portion, said head portion defining a radially extending engagement surface terminating in a head portion lower edge, said shank portion orthogonal to said swiveling roofing washer and extending through said fastener opening and said throughbore, and engaged to said decking surface whereby said head engagement surface engages said convex surface, and whereby when said roofing washer is tilted, said head engagement surface swivels on said convex surface, and said lower edge engages said channel.

19. The roofing system assembly of claim 18 wherein said convex surface is spherical.

20. The roofing system assembly of claim 19 wherein said convex surface has a radius of curvature of about 0.4 inches.

21. The roofing system assembly of claim 18 wherein said swiveling roofing washer further comprises a plurality of annular reinforcing ribs coaxial with said fastener opening.

* * * * *